United States Patent [19]

Obayashi et al.

[11] 4,324,827

[45] Apr. 13, 1982

[54] WATER-PROOF, FUSE-BONDING FABRIC

[75] Inventors: Tsutomu Obayashi, Tokyo; Hideyuki Hiraoka, Musashino, both of Japan

[73] Assignee: Hiraoka & Co., Ltd., Tokyo, Japan

[21] Appl. No.: 109,250

[22] Filed: Jan. 3, 1980

[30] Foreign Application Priority Data

| | | | |
|---|---|---|---|
| Jan. 17, 1979 | [JP] | Japan | 54/4731[U] |
| Feb. 28, 1979 | [JP] | Japan | 54/25036[U] |
| Mar. 24, 1979 | [JP] | Japan | 54/34689[U] |
| Apr. 16, 1979 | [JP] | Japan | 54/46519[U] |
| Sep. 29, 1979 | [JP] | Japan | 54/126139[U] |
| Nov. 5, 1979 | [JP] | Japan | 54/ 142043[U] |

[51] Int. Cl.[3] ..... B32B 23/02

[52] U.S. Cl. ..... 428/192; 427/45.1; 427/375; 427/393.4; 428/193; 428/194; 428/195; 428/196; 428/198; 428/245; 428/246; 428/290; 428/913

[58] Field of Search ..... 428/192, 193, 194, 196, 428/197, 198, 245, 246, 254, 260, 264, 265, 266, 284, 289, 290, 286, 287, 262; 427/393.4, 412, 375, 45.1

[56] References Cited

U.S. PATENT DOCUMENTS

| | | | |
|---|---|---|---|
| 3,476,587 | 11/1969 | Demol et al. | 428/246 |
| 3,511,699 | 5/1970 | Johnson et al. | 428/266 |
| 3,585,103 | 6/1971 | Thomson | 428/266 |
| 3,616,146 | 10/1971 | Gabet | 428/261 |
| 3,650,813 | 3/1972 | Nordstrom et al. | 428/266 |
| 3,653,952 | 4/1972 | Gagliardi | 428/266 |
| 3,844,829 | 10/1974 | Black | 427/393.4 |
| 3,852,090 | 12/1974 | Leonard et al. | 428/246 |
| 3,950,578 | 4/1976 | Laumann | 427/393.4 |
| 4,004,059 | 1/1977 | Deiner et al. | 428/266 |
| 4,054,592 | 10/1977 | Dear et al. | 427/393.4 |
| 4,151,327 | 4/1979 | Lawton | 427/393.4 |
| 4,156,753 | 5/1979 | Tanaka | 428/262 |
| 4,172,830 | 10/1979 | Rosenberg et al. | 428/260 |
| 4,211,815 | 7/1980 | Deiner | 428/262 |
| 4,233,358 | 11/1980 | Jones et al. | 156/230 |
| 4,265,954 | 5/1981 | Romanek | 428/288 |

*Primary Examiner*—James J. Bell

*Attorney, Agent, or Firm*—Benasutti Associates, Ltd.

[57] ABSTRACT

A water-proof fabric capable of providing a fuse-bonding activity by applying a high frequency wave treatment or heating treatment thereto, which is characterized in that at least one fuse-bonding region is formed on at least one surface of the water-proof fabric by coating the surface with a polymeric fuse-bonding agent capable of providing an adhering activity when a high frequency wave treatment or heating treatment is applied thereto.

21 Claims, 14 Drawing Figures

WATER-PROOF, FUSE-BONDING FABRIC

FIELD OF THE INVENTION

The present invention relates to a water-proof, fuse-bonding fabric. More particularly, the present invention relates to a water-proof fabric capable of fuse-bonding welding by applying a high frequency wave treatment or a heating treatment thereto.

BACKGROUND OF THE INVENTION

It is known that conventional water-proof, fuse-bonding fabric can be produced by coating at least one surface of a fabric, for example, a woven canvas, with a synthetic resin, such as polyvinyl chloride, which is capable revealing the sn adhering activity when a high frequency wave treatment or heat treatment is applied thereto. However, the above-mentioned conventional water-proof, fuse-bonding fabric has the following disadvantages.

1. Since the specific gravity of the synthetic resin, such as polyvinyl chloride, is high, the resultant water-proof fabric is very heavy.

2. Since the synthetic resin forms a continuous non air-permeable layer on the surface of the fabric, the resultant water-proof fabric is not air-permeable.

The former disadvantage can be eliminated by replacing the synthetic resin, such as polyvinyl chloride, having a high specific gravity with another synthetic resin, for example, acrylic resin and chloro-sulfonated polyethylene, having a low specific gravity. However, these low specific gravity synthetic resins are not capable of providing adhering activity even when the high frequency treatment or heating treatment is applied thereto.

The latter disadvantage can be eliminated by impregnating the fabric with an air-permeable water-proofing agent, for example, paraffin, metallic soap, zirconium compound or silicone. In this case, it is preferable that the fabric to be water-proofed comprise cellulose fibers, for example, cotton, linen or rayon. This type of air-permeable, water-proof celullose fiber fabric is suitable for various covering sheets, for example, hoods of trucks and boats, which are required to be highly air-permeable. If the covering sheet is not air-permeable, a reduction in the atmospheric temperature will cause moisture in a space covered by the covering sheet to be condensed so as to form water drops on the lower surface of the covering sheet, and then, the condensed water drops to fall down and wet articles under the covering sheet. However, the conventional air-permeable, water-proof fabric cannot be fuse-bonded by applying the high frequency wave treatment or the heating treatment thereto.

The fuse-bonding operation for the water-proof fabric is simpler and easier to perform than the conventional operation for sewing. Accordingly, it is desirable to provide a water-proof fabric which is capable of fuse-bonding by applying the high frequency wave treatment or heating treatment thereto, in spite of the fact that the water-proof fabric has been impregnated with an air-permeable water proofing agent or coated with a synthetic resin not capable of fuse-bonding.

SUMMARY OF THE INVENTION

An object of the present invention is to provide a water-proof, fabric capable of fuse bonding by applying a high frequency wave treatment or heating treatment thereto, in spite of the fact that the water-proof fabric has been impregnated with an air-permeable water-proofing agent which is not capable of fuse-bonding, or coated with a water-proofing synthetic resin which is not capable of fuse-bonding.

The above-mentioned object can be attained by the water-proof, fuse bonding fabric of the present invention, which comprises a water-proof fabric consisting of a fabric substrate impregnated or coated with a water-proofing agent not capable of providing adhering activity even when a high frequency wave treatment or heating treatment is applied thereto, and which is characterized by at least one fuse-bonding region formed on at least one surface of said water-proof fabric, in which region said surface is coated with a polymeric fuse-bonding agent capable of providing an adhering activity when a high frequency wave treatment or heating treatment is applied thereto.

DETAILED DESCRIPTION OF THE INVENTION

Figure 1:
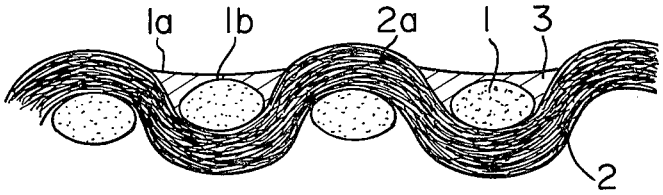
FIG. 1 is an explanatory cross-sectional view of a fuse-bonding region in an embodiment of the water-proof, fuse-bonding fabric of the present invention.

In the water-proof, fuse-bonding fabric of the present invention, the fabric substrate may be any woven fabric, knitted fabric or non-woven fabric. The fabric substrate may be made of any type of fiber, that is, natural fibers, for example, cotton, linen and jute; regenerated fibers, for example, rayon and cupra; semi-synthetic fibers, for example, cellulose acetate fibers; synthetic fibers, for example, nylon 6, nylon 66, polytetmethylene terephthalate, polyacrylic, polyolefin or water-insolubilized polyvinyl alcohol fibers; mineral fibers, for example, glass fibers, and; mixtures of two or more of the above-mentioned types of fibers. In the case where the fabric substrate is a woven fabric or a knitted fabric, the fibers may be in the form of staple fibers or multifilaments, and also, in the form of a spun yarn, multifilament yarn, split yarn, or tape yarn.

The water-proofing agent to be impregnated in the fabric substrate may be an air-permeable water-proofing agent, for example, paraffin, wax, metallic salt, such as aluminium acetate; metallic soap, such as aluminium soap, rosin soap; zirconium compounds, such as zirconium salts of fatty acids; silicon compounds, such as methylhydrogen polysiloxane; chromium complexes, such as stearyl chromic chloride; octadecyloxymethylpyridinium chloride; stearamidemethylpyridinium chloride; octadecylethylene urea; alkylketene dimers, methylol stearamide, and; perfluorocarbon compounds. These agents and compounds are applied in an amount (dry weight) of from 3 to 30%, based on the weight of the fabric substrate. When the fabric substrate comprises cellulose fibers, the water-proofing agent is usually selected from the air-permeable water-proofing agents which cause the resultant water-proof fabrics to be air-permeable. The air-permeable water-proof fabrics allow moisture in the atmosphere to pass therethrough. This feature of the air-permeable, water-proof fabrics is effective for preventing the formation of drops of dew on the surfaces of the water-proof fabrics when the temperature of the space surrounded by the water-proof fabrics lowers.

Usually, the air-permeable, water-proofing agent is applied in the form of an aqueous solution, emulsion or suspension to the fabric substrate and, then, if necessary, the fabric is heat-treated at an elevated temperature to cure the water-proofing agent. However, in the case of metallic soap, the fabric substrate may be impregnated with an aqueous solution of sodium or ammonium soap and, then, brought into contact with an aqueous solution of a water-soluble metal salt, such as aluminium sulfate, so as to convert the sodium or ammonium soap to aluminium soap.

The air-permeable water-proofing agents have no fuse-bonding activity even when a high frequency wave treatment or heating treatment is applied thereto.

In the present invention, the water-proofing agent to be impregnated in or coated on the fabric substrate, may be selected from polymeric synthetic resins, for example, acrylic resins, such as polyacrylic alkyl esters, and petroleum resins, alkyl resins, chlorosulfonated polyethylene resins, polyolefins, melamine resins and cross-linked rubbers which are not capable of revealing an adhering activity even when a high frequency wave treatment or heating treatment is applied thereto. When the polymeric resin is impregnated into the fabric substrate, the fabric substrate is immersed in a solution, emulsion or suspension of the polymeric resin, removed therefrom, squeezed so as to maintain the desired amount of the polymeric resin in a range of from 50 to 300%, based on the weight of the fabric substrate, dried, and then, if necessary, cured at an elevated temperature. The solution, emulsion or suspension of the polymeric resin may be applied to the fabric substrate by spraying.

The coating operation for the fabric substrate can be effected with a paste of the polymeric resin by using any of the conventional coating apparatuses and spraying apparatuses.

Usually, the water-proof fabric consisting of a fabric substrate impregnated or coated with the above-mentioned polymeric synthetic resins, are air-nonpermeable.

The water-proof, fuse-bonding fabric of the present invention is provided with at least one fuse-bonding region formed on at least one surface of the water-proof fabric. In the fuse-bonding region, a polymeric fuse-bonding agent is applied to the surface of the water-proof fabric. The fuse-bonding agent is capable of providing adhering activity when the high frequency wave treatment or heating treatment is applied thereto. The fuse-bonding agent may comprise at least one member selected from the group consisting of polyvinyl chloride, ethylene-vinyl acetate copolymers, ethylene-vinyl chloride copolymers, polyurethans and polyamides, which are capable of revealing adhering activity when the high frequency wave treatment is applied thereto. Also, the fuse-bonding agent may comprise at least one member selected from the group consisting of polyamides, for example, nylon 11 and nylon 12, and polyvinyl chloride, ethylene-vinyl acetate copolymers and polyurethane, which are capable of revealing adhering activity when the heating treatment at a temperature of from 150° to 350° C. is applied thereto.

In the case where the water-proof fabric is air-permeable, the fuse-bonding region can be formed by coating it with the polymeric fuse-bonding agent in such a manner that a number of concavities formed in the weave structure of the water-proof fabric are stuffed with the polymeric fuse-bonding agent and a number of convexities formed in the wave structure of the fabric are free from the polymeric fuse-bonding agent.

Referring to FIG. 1, a weave structure is formed by warp yarns 1 and weft yarns 2 combined with each other, so as to form therein a number of concavities 1*a* and a number of convexities 2*a*. The concavities 1*a* are stuffed by a polymeric fuse-bonding agent 3. However, the convexities 2*a* are substantially free from the polymeric fuse-bonding agent 3.

In the above-mentioned case, the fuse-bonding region is air-permeable, because the convexities in the region are substantially free from the fuse-bonding agent and, therefore, air-permeable.

Figure 2:
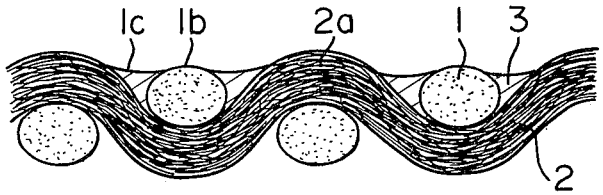
FIG. 2 is an explanatory cross-sectional view of a fuse-bonding region in another embodiment of the water-proof, fuse-bonding fabric of the present invention.

Referring to FIG. 2, top portions (convexities) 1*b* of the warp yarns 1 are substantially free from the polymeric fuse-bonding agent, whereas concavities 1*c* formed between the warp yarns 1 and weft yarns are stuffed with the polymeric fuse bonding agent 3. In this case, the fuse-bonding region is air-permeable, because the convexities 26 and the top portions 1*b* of the warp yarns 1 are substantially free from the polymeric fuse-bonding agent and, therefore, they are air-permeable.

The above-mentioned fuse-bonding region in which only the concavities in the weave structure are stuffed with the polymeric fuse-bonding agent, is prepared by coating desired portions of the surfaces of the water-proof fabric with the polymeric fuse-bonding agent, so as to fill the concavities in the weave structure in the portions with the polymeric fuse-bonding agent, and then, by removing portions of the polymeric fuse-bonding agent located on the convexities in the weave structure by using a doctor knife.

The above-mentioned fuse-bonding region may be either located in desired portions of the surfaces of the water-proof fabric or formed on the entire area of one surface of the water-proof fabric. In the latter case, the resultant water-proof, fuse-bonding fabric is air-permeable and can be fuse-bonded at any portions of the surface to another fabric.

Figure 3:
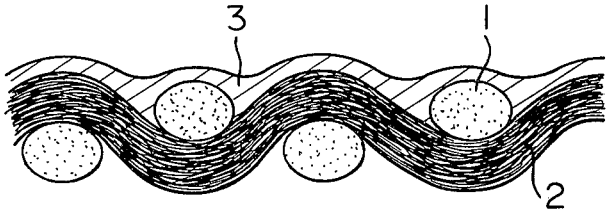
FIG. 3 is an explanatory cross-sectional view of a fuse-bonding region in still another embodiment of the water-proof, fuse-bonding fabric of the present invention.

The fuse-bonding region can be formed by coating desired portions of the surfaces of the water-proof fabric with the polymeric fuse-bonding agent so as to form a continuous coating layer of the fuse-bonding agent fixed to the water-proof fabric surface. Referring to FIG. 3, not only are the concavities in the weave structure stuffed with the polymeric fuse-bonding agent 3, but also, the convexities in the weave structure are covered with the polymeric fuse bonding agent 3. Accordingly, in this case, the fuse-bonding region is not air-permeable.

Also, the continuous coating layer of the polymeric fuse-bonding agent can be prepared by adhering a film of the fuse-bonding agent onto the surface of water-proof fabric by using an adhering agent, for example, isocyanate resins and epoxy resins, or by applying a heat-pressing operation thereto. The heat-pressing operation can be carried out by superimposing a film of the polymeric fuse-bonding agent having a thickness of from 0.05 to 0.5 mm on a surface of a desired portion of the water-proof fabric and by pressing the film and fabric between a pair of calender rollers at an elevated temperature at which the film can be fuse-adhered to the fabric.

The fuse-bonding region may be formed in any portion of the surfaces of the water-proof fabric at which portion the water-proof fabric is desired to be bonded to another fabric.

Figure 4:
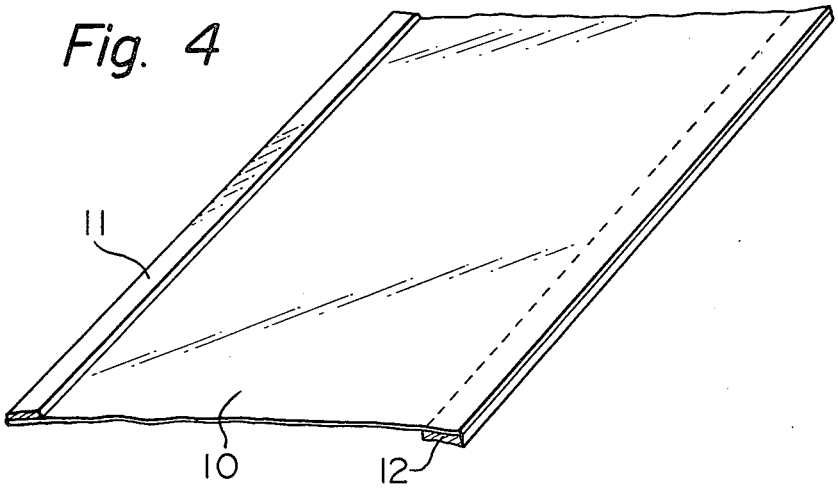
FIG. 4 is a schematic view of an embodiment of the water-proof, fuse-bonding fabric of the present invention having two belt-patterned fuse-bonding regions.
Figure 5:
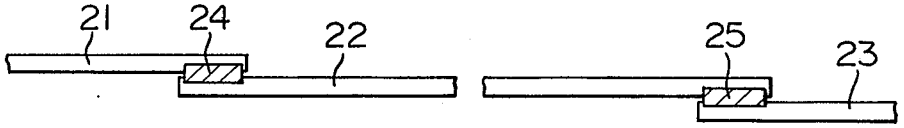
FIG. 5 is an explanatory cross-sectional view of three pieces of the water-proof, fuse-bonding fabrics of the type indicated in FIG. 4, which are fuse-bonded to each other.

Referring to FIG. 4, a water-proof, fuse-bonding fabric 10 is provided with two fuse-bonding regions 11 and 12, which are each in the pattern of a belt extending in parallel to the longitudinal axis of the fabric 10. The fuse-bonding region 11 is located along the left edge end on the upper surface of the fabric 10. The fuse-bonding region 12 is located along the right edge end on the lower surface of the fabric 10. A plurality of the fuse-bonding fabrics of the above-mentioned type can be fuse-bonded to each other in the manner indicated in FIG. 5. Referring to FIG. 5, three fabrics 21, 22 and 23 are connected in such a manner that a fuse-bonding region located at the right edge end on the lower surface of the fabric 21 is superimposed on and fuse-bonded to a fuse-bonding region located at the left edge end on the upper surface of the fabric 22, so as to form a fuse-bond 24, and a fuse-bonding region located at the right edge end on the lower surface of the fabric 22 is superimposed on and fuse-bonded to a fuse-bonding region located at the left edge end on the upper surface of the fabric 23, so as to form a fuse-bond 25. The fuse-bonding region in the pattern of a belt preferably has a width of from 1 to 5 cm, more preferably, from 2 to 3.5 cm.

Figure 6:
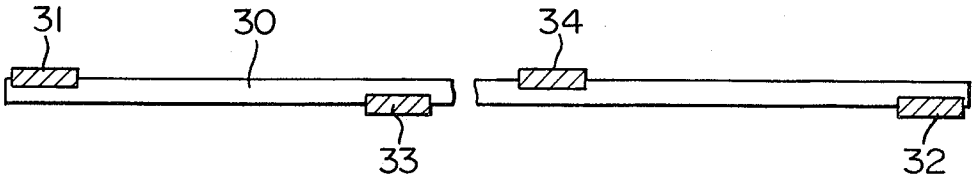
FIG. 6 is an explanatory cross-sectional view of another embodiment of the water-proof, fuse-bonding fabric of the present invention having four or more belt-patterned fuse-bonding regions.
Figure 7:
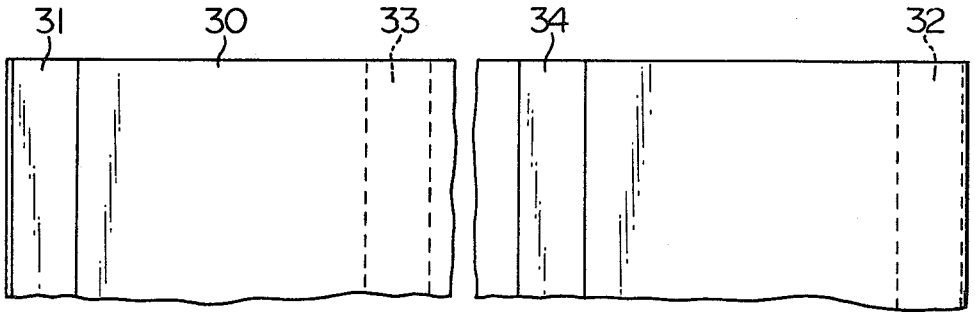
FIG. 7 is an explanatory plan view of the water-proof, fuse-bonding fabric indicated in FIG. 6.

Referring to FIGS. 6 and 7, a fabric 30 is provided with a plurality of fuse-bonding regions 31, 32, 33 and 34, each in the pattern of a belt extending in parallel to the longitudinal axis of the fabric 30. The fuse-bonding regions 31 through 34 are spaced with predetermined intervals from each other. The fuse-bonding regions 31 and 34 are located on the upper surface of the fabric 30 and the fuse-bonding regions 32 and 33 are located on the lower surface of the fabric 30. This type of fabric is divided in parallel to the longitudinal axis of the fabric into a plurality of pieces each having at least oen fuse-bonding region.

Figure 8:
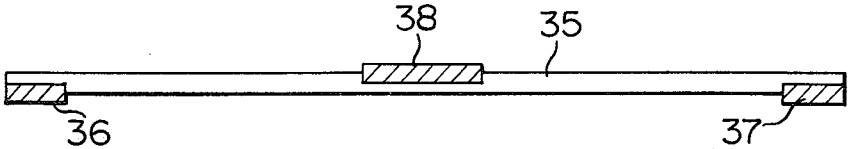
FIG. 8 is an explanatory cross-sectional view of still another embodiment of the water-proof, fuse-bonding fabric of the present invention having three fuse-bonding regions.

Referring to FIG. 8, a water-proof, fuse-bonding fabric 35 is provided with three fuse-bonding regions 36, 37 and 38 each in the pattern of a belt extending in parallel to the longitudinal axis of the fabric 35. The fuse-bonding regions 36 and 37 have the same width as each other and are located at the left and right edge ends of the lower surface of the fabric 35, respectively. The fuse-bonding 38 is located along the longitudinal center line on the upper surface of the fabric 35, and has a width of twice that of the fuse-bonding regions 36 and 37. This type of water-proof, fuse-bonding fabric can be divided along the longitudinal center line of the fabric 35 into two pieces, each having a fuse-bonding region located at an edge end on a surface of the piece and another fuse-bonding region located at the opposite edge end on the opposite surface of the piece.

The water-proof, fuse-bonding fabric of the present invention may be provided with a fuse-bonding region in the pattern of checks or a network formed on at least one surface of the fabric.

Figure 9:
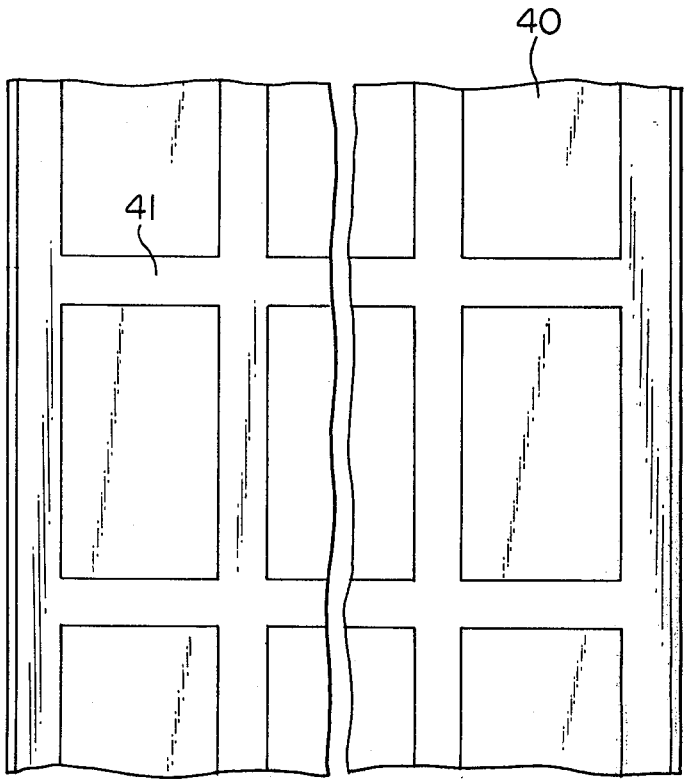
FIG. 9 is an explanatory plan view of a further embodiment of the water-proof, fuse-bonding fabric of the present invention, which has a fuse-bonding region in a check pattern.

Referring to FIG. 9, a fabric 4 is provided with a fuse-bonding region 41 in the pattern of checks composed of a plurality of stripes extending in parallel to the longitudinal axis of the fabric and a plurality of stripes extending at an angle normal to the longitudinal axis of the fabrics. It is preferable that each stripe has a width of from 1 to 5 cm, more preferably, 2 to 3.5 cm.

Figure 10A:
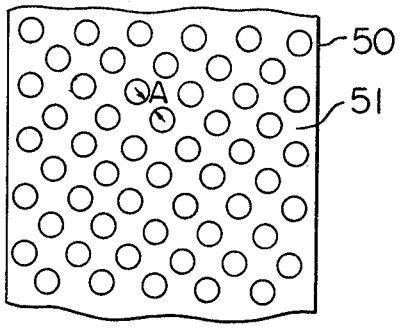
FIGS. 10A, 10B and 10C are each an explanatory plan view of a still further embodiment of the water-proof, fuse-bonding fabric of the present invention, which has a fuse-bonding region in the pattern of a network.
Figure 10B:
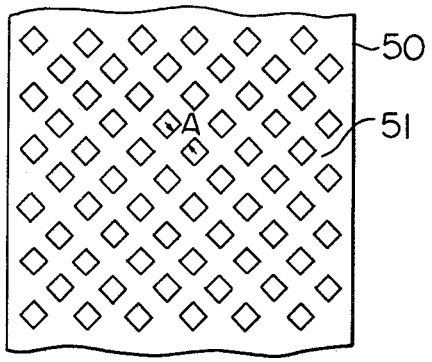
Figure 10C:
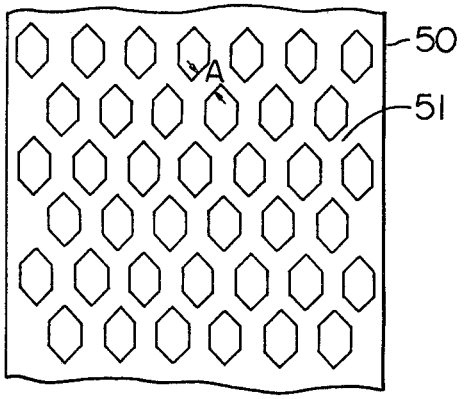

Referring to FIGS. 10A, 10B and 10C, each fabric 50 is provided with a fuse-bonding region 51 in the pattern of a network.

In the fuse-bonding region in the pattern of a network, as indicated in FIG. 10A, 10B or 10C, it is preferable that the smallest width A is in a range of from 1 to 5 cm, more preferably, from 2 to 3.5 cm.

Figure 11:
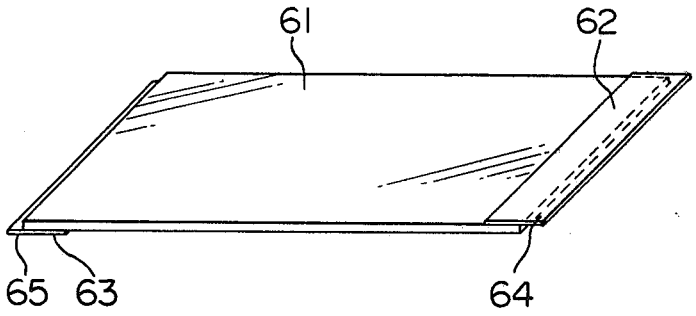
FIG. 11 is a schematic view of another embodiment of the water-proof, fuse-bonding fabric of the present invention, which has two fin-shaped films, each projected from a fuse-bonding region.

In the case where a continuous layer of the fuse-bonding agent is formed in a fuse-bonding region located in an edge end portion of a fabric, the continuous layer may extend and project from the edge end of the fabric to the outside of the fabric so as to form a fin-shaped film of the fuse-bonding agent. Referring to FIG. 11, a water-proof, fuse-bonding fabric 61 is provided with a right fuse-bonding region 62 and a left fuse-bonding regions 63, in each of which a continuous coating film of the polymeric fuse-bonding agent is formed, and which are in the pattern of a belt. The right fuse-bonding region 62 is located on the upper surface of the fabric 61 and the left fuse-bonding region 63 is located on the lower surface of the fabric 61. Each continuous layer of the polymeric fuse-bonding agent is extended so that a fin-shaped film 64 or 65 projects from the edge end of the fabric to the outside of the fabric.

Figure 12:
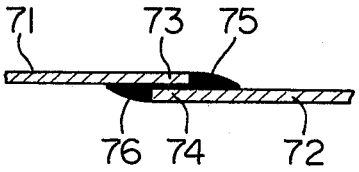
FIG. 12 is an explanatory cross-sectional view of two pieces of the water-proof, fuse-bonding fabrics of the type indicated in FIG. 11, which are fuse-bonded to each other.

Referring to FIG. 12, a fabric 71 is superimposed on a fabric 72 in such a manner that a fuse-bonding region 73 of the fabric 71 contacts a fuse-bonding region 74 of the fabric 72. When a high frequency wave treatment or heating treatment is applied, the fuse-bonding regions 73 and 44 are fuse-bonded to each other, and a fin-shaped film 75 of the fabric 71 and a fin shaped film 76 of the fabric 72 are fused and bonded to the upper surface of the fabric 72 and the lower surface of the fabric 71, respectively. That is, the fuse-bonded fin-shaped films 75 and 76 not only reinforce the bond between the fabric 71 and the fabric 72, but also, protect the fuse-bonded portion of the fabrics from water.

The coating operation for forming the fuse-bonding regions can be carried out by using any conventional coating apparatuses, spraying apparatuses and printing apparatuses. The coating apparatuses include doctor coating apparatuses and roller coating apparatuses. The printing apparatuses include dram printing machines and screen printing machines.

In the coating operation, it is preferable that the amount (dry weight) of the fuse-bonding agent applied onto the fuse-bonding region be in a range of from 30 to 500 g/m$^2$.

The formation of the fuse-bonding region may be carried out either before or after the water-proofing agent is applied to the fabric substrate. However, it is preferable that the fuse-bonding region be formed before the water-proofing operation is applied to the fabric substrate.

A plurality of pieces of the water-proof, fuse-bonding fabric of the present invention can be fuse-bonded to each other in such a manner that a fuse-bonding region of a piece of the fabric is superimposed on another fuse-bonding region of another piece of the fabric so that both the fuse-bonding regions face each other, the superimposed fuse-bonding regions are subjected to a high frequency wave treatment or heating treatment.

The high frequency wave treatment can be effected by applying high frequency waves having a frequency of from 13 to 5850 MHz, preferably, from 13 to 45 MHz, generated from a high frequency wave oscillator, to the superimposed fuse-bonding regions. This treatment causes the polymeric fuse-bonding agent in the superimposed fuse-bonding regions to be fused and to adhere the regions to each other.

The heating treatment can be conducted by heat pressing the superimposed fuse-bonding regions at a temperature of 150° to 350° C. above the melting point of the fuse-bonding agent.

The present invention will be further illustrated by the following examples, which are provided for the purpose of illustration and should not be interpreted as in any way limiting the scope of the present invention.

EXAMPLE 1

A fabric substrate was prepared by scouring a cotton canvas having a weight of 420 g/m$^2$ with an aqueous solution of 5 g/l of sodium hydroxide, at a temperature of 85° C., for 30 minutes. Then the scoured fabric was dyed with Indanthrene Olive MW, in an amount of 5%, based on the weight of the scoured fabric, in an ordinary manner. The dyed fabric was dried by using a cylinder dryer heated with steam at a pressure of 1.5 kg/cm$^2$G.

The fabric substrate was subjected to a process for the formation of fuse-bonding regions which were each in the pattern of a belt having a width of 2.5 cm. One of the fuse-bonding regions was formed at an edge portion on a surface of the fabric and the other was formed at the opposite edge portion on the opposite surface of the fabric. Each fuse-bonding region was formed by coating the edge portions with a paste consisting of 90 parts by weight of a vinyl chloride-vinyl acetate copolymer (7:3 by weight) and 10 parts by weight of a solvent consisting of trichloroethylene, and having a viscosity of 30 poises, and; then, by scratching the layer of the paste with a doctor knife so that the concavities in the weave structure of the fabric were stuffed with the paste and the convexities in the weave structure became substantially free from the paste. Thereafter, the paste in the concavities in the weave structure was dried at a temperature of 150° C. The amount of the fuse-bonding agent in the fuse-bonding region was 40 g/m$^2$.

Next, the fabric was subjected to an ordinary water-proofing process in which paraffin, rosin soap and aluminium soap were used as a water-proofing agent.

Three-pieces of the above-prepared water-proof, fuse-bonding fabric were superimposed on each other in the manner indicated in FIG. 5. Then, the superimposed pieces were subjected to a high frequency wave treatment for 3 minutes, by using a high frequency wave oscillator having an output of 2 KW and a frequency of 40.68 MHz. The fuse-bonded pieces of the fabric exhibited an excellent average resistance to peeling of 9.0 kg/3 cm.

EXAMPLE 2

The same procedures as those mentioned in Example 1 were carried out, except that the formation of the fuse-bonding region was carried out after the fabric substrate was water-proofed with the aluminium soap. The resultant fuse-bonded pieces of the water-proof, fuse-bonding fabric exhibited an average resistance to peeling of 5.5 kg/3 cm, which is high enough for practical use of the fabric.

COMPARATIVE EXAMPLE 1

The same water-proof fabric as that mentioned in Example 2 was prepared. Three pieces of the water-proof fabric were superimposed on each other in the manner indicated in FIG. 5. Then, a piece of a tape consisting of a polyamide (nylon 12), and having a width of 2.5 cm, was interposed between the respective superimposed fabric pieces. The superimposed fabric pieces were subjected to the same high frequency wave treatment as that mentioned in Example 1. The resultant fuse-bonded fabric pieces exhibited a poor average resistance to peeling of 3.0 kg/3 cm, which is unsatisfactory for practical use.

EXAMPLE 3

The same procedures for preparing the water-proof, fuse-bonding fabric as those mentioned in Example 1 were carried out, except that each of the fuse-bonding regions was formed by placing a polyvinyl chloride tape having a thickness of 0.3 mm and a width of 3.0 cm, on the edge portion of the fabric, and; then, by heat-fusing the tape at a temperature of 210° C., so that the edge portion of the fabric was coated with a continuous layer of the fused polyvinyl chloride.

The same procedures for fuse-bonding the three pieces of the fabric as those mentioned in Example 1 were carried out, except that a hot air fuse-bonding machine, having a 750 W heater, was used in place of the high frequency wave oscillator. In the fuse-bonding operation, the superimposed pieces of the fabric were pressed between a pair of silicone pressing rollers at a pressure of 8 kg/cm and heated with hot air blown through a slit, having a width of 30 mm and a length of 40 mm, at a temperature of 200° C. The resultant fuse-bonded pieces of fabric exhibited an excellent peeling resistance of 9.3 kg/3 cm.

EXAMPLE 4

A plain woven fabric substrate consisting of 28 two folded warp yarns/2.54 cm and 28 two folded weft yarns/2.54 cm, each two folded yarn consisting of two polyethylene terephthalate fiber spun single yarns, each having a metric count of 10, was coated with an adhesive in an amount of 10 g/m$^2$, and; then, with a water-proofing agent consisting of an acrylic resin in an amount of 100 g/m$^2$. The resultant water-proof fabric was subjected to the same procedures for forming the fuse-bonding regions as those mentioned in Example 3 and, then, to the same fuse-bonding procedures as those mentioned in Example 1. The resultant fuse-bonded pieces of the fabric exhibited an excellent peeling resistance of 9.2 kg/3 cm.

EXAMPLE 5

The same polyethylene terephthalate fabric as that mentioned in Example 4 was scoured with a scouring liquid containing 0.5% by weight of a non-ionic surface active agent at a temperature of 80° C. for 30 minutes, and then, dried. Two fuse-bonding regions, each having a width of 3 cm, were formed in the same manner as that mentioned in FIG. 4 on the fabric substrate, by coating the region with an epoxy resin adhesive in an amount of 20 g/m$^2$, and; then, by coating the regions with a paste of 90% by weight of a polyvinyl chloride in a solvent, consisting of trichloroethylene, in such a manner that a portion of the paste penetrated into the fabric and the remaining portion of the paste formed a continuous layer of the paste, having a thickness of 0.1 mm, on the fabric surface. Thereafter, the polyvinyl chloride paste was gelatinized and solidified in the ordinary manner.

The fabric with the fuse-bonding regions was impregnated with 100%, based on the weight of the fabric, of a solution of 100% by weight of a chlorosulfonated polyethylene (Trademark: Hipalone, made by Du Pont) in toluene, squeezed by using a mangle so as to maintain 100% of the solution, based on the weight of the fabric, in the fabric. The squeezed fabric was cured at a temperature of 140° C. for 4 minutes. The same fuse-bonding operation as that mentioned in Example 1 was applied to the water-proof, fuse-bonding fabric. The resultant fuse-bonded pieces of the fabric exhibited an excellent peeling resistance of 9.8 kg/3 cm.

EXAMPLE 6

The same procedures as those mentioned in Example 5 were carried out, except that after the water-proofing operation, the same paste of polyvinyl chloride as that mentioned in Example 5 was applied onto the fuse-bonding regions, so as to form an additional continuous layer of the paste. Then, the paste layer was gelatinized and solidified. The resultant fuse-bonded pieces of the fabric exhibited an excellent peeling resistance of 10.2 kg/3 cm.

EXAMPLE 7

The same procedures as those mentioned in Example 4 were carried out, except that two pieces of the polyvinyl chloride tape were adhered to the edge portions of the fabric by using an adhesive consisting of an epoxy resin (Sony Bond 513A/B, Trademark, made by Sony Chemical Co.) in an amount of 10 g/m$^2$, and then, the adhered pieces of the polyvinyl chloride tape were fused, at a temperature of 210° C. so as to form a continuous coating layer. The resultant fuse-bonded pieces of the fabric exhibited an excellent peeling resistance of 10.8 kg/3 cm.

EXAMPLE 8

The same procedures as those mentioned in Example 1 were carried out, except that the fuse-bonding regions were formed in the same manner as that mentioned in Example 3, and the fuse-bonding operation was carried out in the same manner as that mentioned in Example 3. The resultant fuse-bonded pieces of the fabric exhibited an excellent peeling resistance of 9.3 kg/3 cm.

EXAMPLE 9

The same cotton convas as that described in Example 1 was subjected to the same procedures for forming the fuse-bonding regions as those described in Example 1, except that the edge portions of the fabric having a width of 3 cm were each coated with a layer of an epoxy resin adhesive having a thickness of 0.03 mm, and; then, a polyvinyl chloride tape, having a width of 35 mm and a thickness of 0.1 mm, was adhered to each edge portion of the fabric in such a manner that an edge portion of the tape in a width of 3 mm projected from the edge end of the fabric, so as to form a fin-shaped film. Thereafter, the fabric with the fuse-bonding regions and the fin-shaped films was water-proofed with an aqueous emulsion containing 50% by weight of paraffin and 30% by weight of aluminium soap. The resultant water-proof, fuse-bonding fabric was subjected to the same fuse-bonding operation as that mentioned in Example 1. The resultant fuse-bonded pieces of the fabric exhibited an excellent peeling resistance of 9.8 kg/cm.

EXAMPLE 10

The same procedures as those mentioned in Example 8 were carried out, except that the fuse-bonding regions were formed by using a polyvinyl chloride tape having a width of 3 cm and a thickness of 0.3 mm, and the fabric substrate with the fuse-bonding regions was water-proofed with an aqueous emulsion containing 50% by weight of paraffin and 30% by weight of aluminium soap. The resultant fuse-bonded pieces of the fabric exhibited an excellent peeling resistance of 9.8 kg/3 cm.

Additionally, the same procedures as those described above were carried out, except that the high frequency wave treatment was replaced by the same heating treatment as that mentioned in Example 3. The resultant fuse-bonded pieces of the fabric exhibited an excellent peeling resistance of 9.8 kg/3 cm.

What we claim is:

1. A water-proof, fuse-bonding fabric which comprises a water-proof fabric including a fabric substrate and at least one coating layer which is formed on at least one surface of said fabric substrate and which comprises a water-proofing agent not capable of providing an adhering activity when a high frequency wave treatment or heating treatment is applied thereto, and which fabric is characterized by at least one fuse-bonding region formed on at least one surface of said water-proof fabric, in which region said surface is partially coated with a polymeric fuse-bonding agent capable of providing an adhering activity when a high frequency wave treatment or heating treatment is applied thereto, said fuse-bonding region forming a pattern which extends longitudinally along said water-proof fabric.

2. A water-proof, fuse-bonding fabric as claimed in claim 1, wherein said fuse-bonding agent which is capable of providing the adhering activity when the high frequency wave treatment is applied thereto comprises at least one member selected from the group consisting of polyvinyl chloride, ethylene-vinyl acetate copolymers, ethylene-vinyl chloride copolymers, polyurethanes and polyamides.

3. A water-proof, fuse-bonding fabric as claimed in claim 1, wherein said fuse-bonding agent which is capable of providing the adhering activity when the heating treatment is applied thereto comprises at least one member selected from the group consisting of polyamides, polyvinyl chloride, ethylene-vinyl acetate copolymers and polyurethanes.

4. A water-proof, fuse-bonding fabric as claimed in claim 1, wherein said fuse-bonding region is in the pattern of a belt.

5. A water-proof, fuse-bonding fabric as claimed in claim 4, wherein said belt-patterned fuse-bonding region is located on an edge end portion of said water-proof fabric.

6. A water-proof, fuse-bonding fabric as claimed in claim 4, wherein one belt-patterned fuse-bonding region is located on one edge end portion on one surface of said water-proof fabric and another belt-patterned fuse-bonding region is located on the opposite edge end portion on an opposite surface of said water-proof fabric.

7. A water-proof, fuse-bonding fabric as claimed in claim 4, wherein said belt-patterned, fuse-bonding region has a width of from 1 to 5 cm.

8. A water-proof, fuse-bonding fabric as claimed in claim 1, wherein said fuse-bonding region is in the pattern of a network.

9. A water-proof, fuse-bonding fabric as claimed in claim 8, wherein the narrowest portions of said fuse-bonding region have a width of from 1 to 5 cm.

10. A water-proof, fuse-bonding fabric as claimed in claim 4, wherein one surface of said water-proof fabric is provided with two belt-patterned fuse-bonding regions which are located on the edge end portions of the fabric and which have a width of from 1 to 5 cm, and wherein the opposite surface of said water-proof fabric is provided with one belt-patterned fuse-bonding region which is located substantially along the longitudinal center line of the fabric and which has a width corresponding to twice that of the fuse-bonding regions which are located on the edge end portions of the fabric.

11. A water-proof, fuse-bonding fabric as claimed in claim 1, wherein, in said fuse-bonding region, said polymeric fuse-bonding agent forms a film capable of being affixed to said water-proof fabric surface.

12. A water-proof, fuse-bonding fabric as claimed in claim 11, wherein said film is affixed with an adhesive onto said water-proof fabric surface.

13. A water-proof, fuse-bonding fabric as claimed in claim 5, wherein said fuse-bonding agent in said belt-patterned, fuse-bonding region located along the edge end portion of the water-proof fabric forms a continuous coating layer fixed to the water-proof fabric surface.

14. A water-proof, fuse-bonding fabric as claimed in claim 13, wherein said continuous coating layer of said fuse-bonding agent is connected to a film of said fuse-bonding agent which forms a fin projecting from the edge end to the outside of the fabric.

15. A water-proof, fuse-bonding fabric as claimed in claim 1, wherein said water-proof fabric is air-permeable.

16. A water-proof, fuse-bonding fabric as claimed in claim 15, wherein the fabric substrate in said air-permeable, water-proof fabric is a woven fabric having a weave structure and wherein, in said fuse-bonding region of said air-permeable, water-proof fabric, said polymeric fuse-bonding agent is stuffed into a number of concavities formed in the weave structure of said fabric, and a number of convexities in the weave structure are substantially free from said polymeric fuse-bonding agent, whereby said fuse-bonding region is air-permeable.

17. A water-proof, fuse-bonding fabric as claimed in claim 16, wherein said air-permeable, fuse-bonding region is formed on the entire area of one surface of said water-proof fabric.

18. A water-proof, fuse-bonding fabric as claimed in claim 15, wherein said water-proofing agent in said air-permeable, water-proof fabric comprises at least one member selected from the group consisting of paraffin, metallic soaps, rosin soap, zirconium salts, silicon compounds, chromium complexes, octadecyloxymethylpyridinium chloride, stearamidemethylpyridinium chloride, octadecylethylene urea, alkylketene dimers, methylol stearamide and perfluorocarbon compounds.

19. A water-proof, fuse-bonding fabric as claimed in claim 1, wherein said water-proof fabric is not air-permeable.

20. A water-proof, fuse-bonding fabric as claimed in claim 19, wherein said water-proofing agent in said non-air-permeable, water-proof fabric comprises at least one member selected from the group consisting of acrylic resins, petroleum resins, alkyd resins, chlorosulfonated polyethylene, polyolefins, melamine resins and cross-linked rubbers which are not capable of providing an adhering activity even when the high frequency wave treatment or heating treatment is applied thereto.

21. A water-proof, fuse-bonding fabric which comprises a water-proof fabric including a woven fabric substrate impregnated or coated with a water-proofing agent not capable of providing an adhering activity when a high frequency wave treatment or heating treatment is applied thereto, and which is characterized by at least one fuse-bonding region formed on at least one surface of said water-proof fabric, in which region said surface is partially coated with a polymeric fuse-bonding agent capable of providing an adhering activity when a high frequency wave treatment or heating treatment is applied thereto, and wherein said coating extends at least partially into the weave of the fabric.

* * * * *

UNITED STATES PATENT OFFICE

CERTIFICATE OF CORRECTION

Patent No. 4,324,827 Dated April 13, 1982

Inventor(s) Tsutomu Obayashi and Hideyuki Hiraoka

It is certified that error appears in the above-identified patent and that said Letters Patent are hereby corrected as shown below:

On the information page, section [30] should read:

[30] Foreign Application Priority Data

| | | | |
|---|---|---|---|
| Jan. 17, 1979 | [JP] | Japan | 54/4731[U] |
| Feb. 28, 1979 | [JP] | Japan | 54/25036[U] |
| Mar. 24, 1979 | [JP] | Japan | 54/34689[P] |
| Apr. 16, 1979 | [JP] | Japan | 54/46519[P] |
| Sep. 29, 1979 | [JP] | Japan | 54/126139[P] |
| Nov. 5, 1979 | [JP] | Japan | 54/142043[P] |

Signed and Sealed this

Twenty-first Day of September 1982

[SEAL]

Attest:

GERALD J. MOSSINGHOFF

Attesting Officer

Commissioner of Patents and Trademarks